US005734996A

United States Patent [19]

Lee

[11] Patent Number: 5,734,996

[45] Date of Patent: *Apr. 7, 1998

[54] DETERGENT DISPENSER FOR TOILETS

[76] Inventor: Kun-Chang Lee, P.O. Box 82-144, Taipei, Taiwan

[ * ] Notice: The terminal 12 months of this patent has been disclaimed.

[21] Appl. No.: 453,394

[22] Filed: May 30, 1995

[51] Int. Cl.[6] ..... E03D 9/02

[52] U.S. Cl. ..... 4/227.3; 4/227.4; 137/433

[58] Field of Search ..... 4/227.2, 227.3, 4/227.4, 227.6; 141/199, 213; 137/395, 398, 433; 222/67

[56] References Cited

U.S. PATENT DOCUMENTS

| | | | |
|---|---|---|---|
| 645,925 | 3/1900 | Bishop et al. | 137/433 |
| 748,515 | 12/1903 | McComb | 137/433 |
| 1,982,062 | 11/1934 | Matthews | 137/433 |
| 4,696,414 | 9/1987 | Huat | 4/227.3 |

FOREIGN PATENT DOCUMENTS

| | | | |
|---|---|---|---|
| 984168 | 7/1951 | France | 4/227.2 |
| 70439 | 8/1893 | Germany | 137/433 |
| 6-117003 | 4/1994 | Japan | 4/227.2 |

*Primary Examiner*—Henry J. Recla
*Assistant Examiner*—Charles R. Ebshway

[57] ABSTRACT

A detergent dispenser including a container having a bottom formed with a downwardly depending tubular portion provided with external threads thereon, a plug having a plurality of longitudinal grooves and an enlarged annular node at an intermediate portion, an upper packing ring mounted on a top of the enlarged annular node of the plug, a lower packing ring mounted on a bottom of the enlarged annular node of the plug, an internally threaded sleeve having an upper opening and a lower opening which is smaller than the upper opening and the enlarged annular node of the plug in diameter, and a buoy threadedly engaged with the lower end of the plug.

2 Claims, 8 Drawing Sheets

DETERGENT DISPENSER FOR TOILETS

BACKGROUND OF THE INVENTION

1. Field of the Invention

This invention relates to a detergent dispenser for a toilet and in particular to one which dispenses detergent only when the toilet is flushed.

2. Background of the Invention

It has been found that the conventional automatic bowl cleaner is simply a block of soluble detergent which is just dropped in a toilet tank. As the detergent dissolves, it will color the water and clean and deodorize the toilet bowl. However, such a detergent continues to dissolve even when the toilet is no longer in use thus incurring prodigious expenditure. Further, another conventional toilet cleaner on the market is a container of liquid detergent which will be discharged continuously once open. Nevertheless, it is obvious that such a toilet cleaner suffers the same drawbacks as the previous discussed automatic bowl cleaner.

Therefore, it is an object of the present invention to provide a detergent dispenser for toilets which can obviate and mitigate the above-mentioned drawbacks.

SUMMARY OF THE INVENTION

This invention pertains to a detergent dispenser for toilets.

It is the primary object of the present invention to provide a detergent dispenser for toilets which will dispense detergent only when the toilet is flushed.

It is another object of the present invention to provide a detergent dispenser for toilets which will not incur prodigious expenditure.

It is still another object of the present invention to provide a detergent dispenser for toilets which can be linearly adjusted to release detergent.

It is still another object of the present invention to provide a detergent dispenser for toilets which is simple in construction.

It is a further object of the present invention to provide a detergent dispenser for toilets which is convenient in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
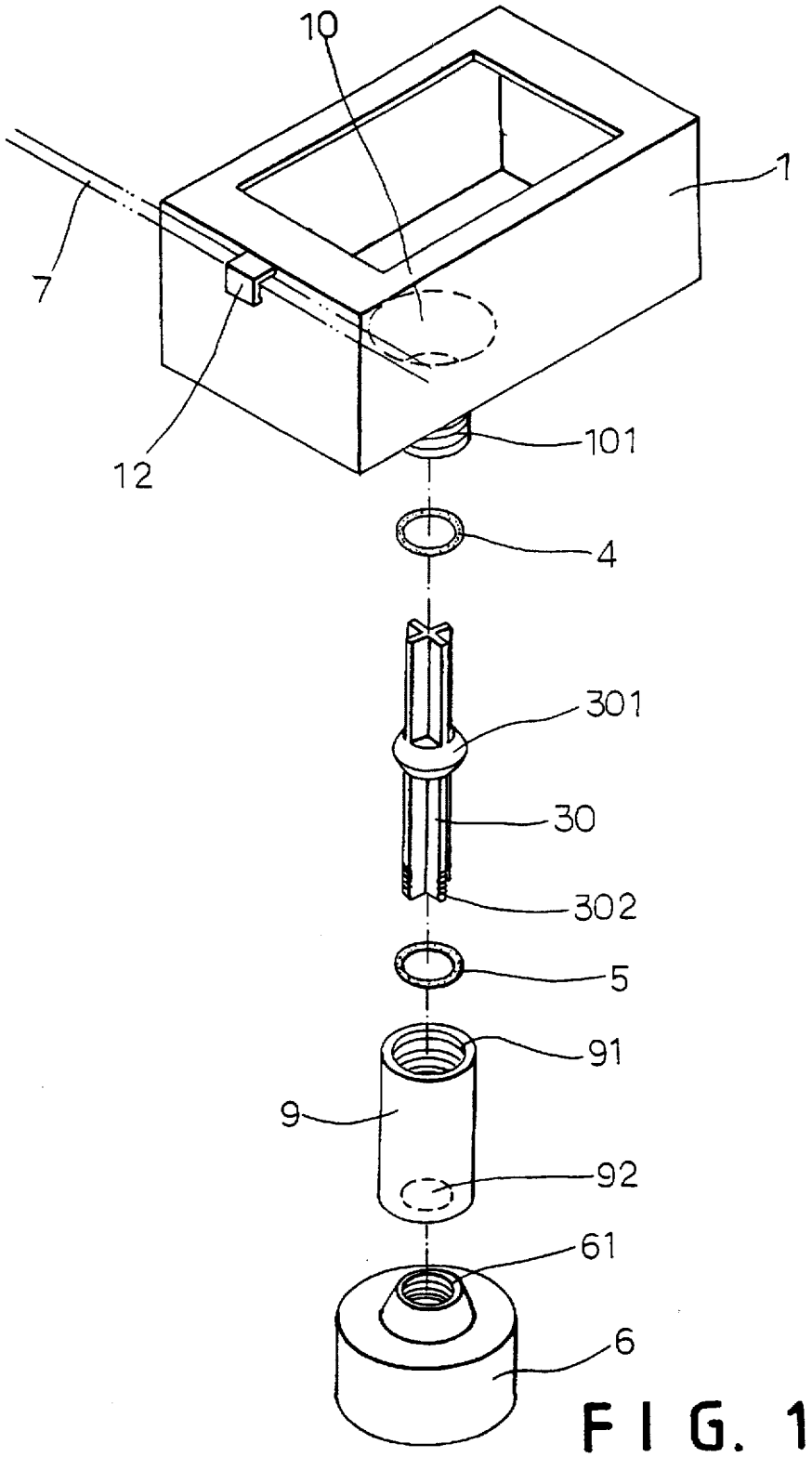
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
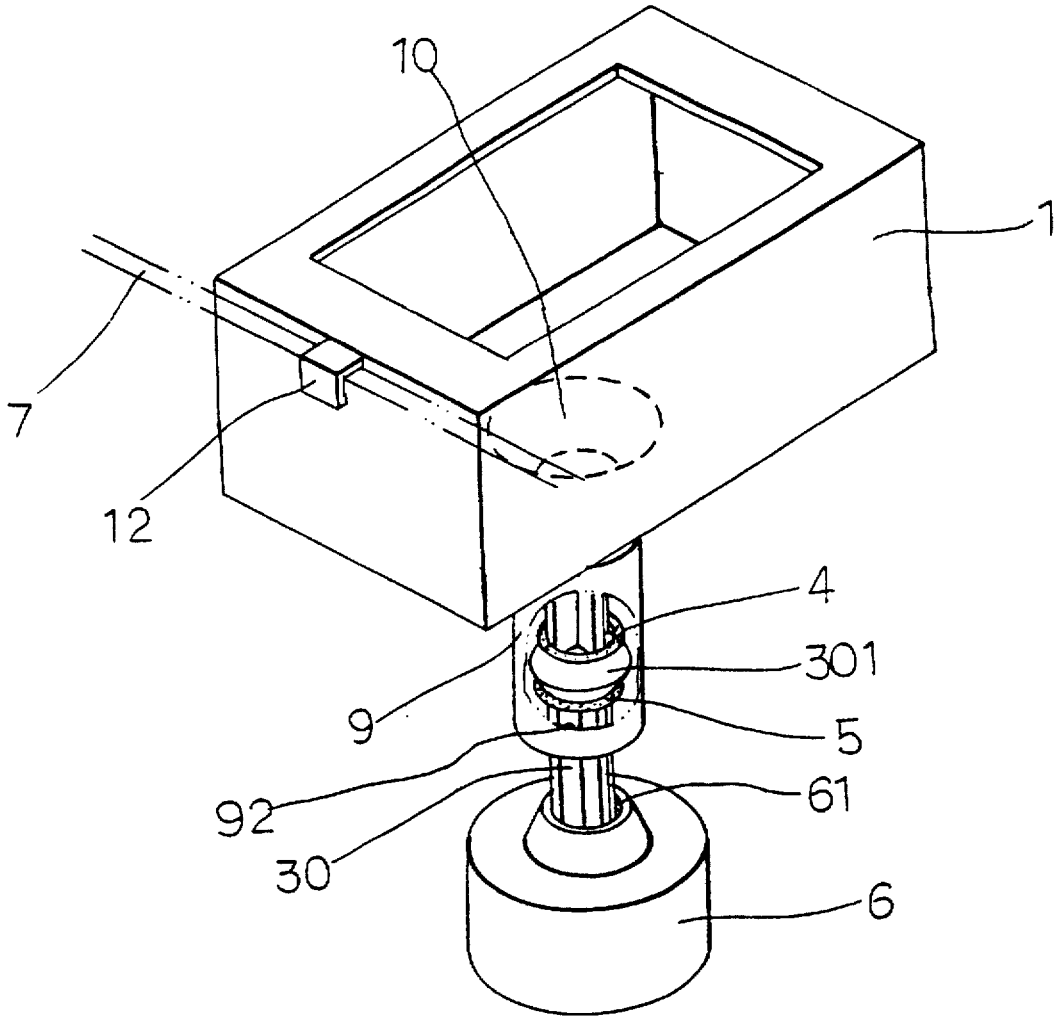
FIG. 2 is a perspective view of the present invention.
Figure 3:
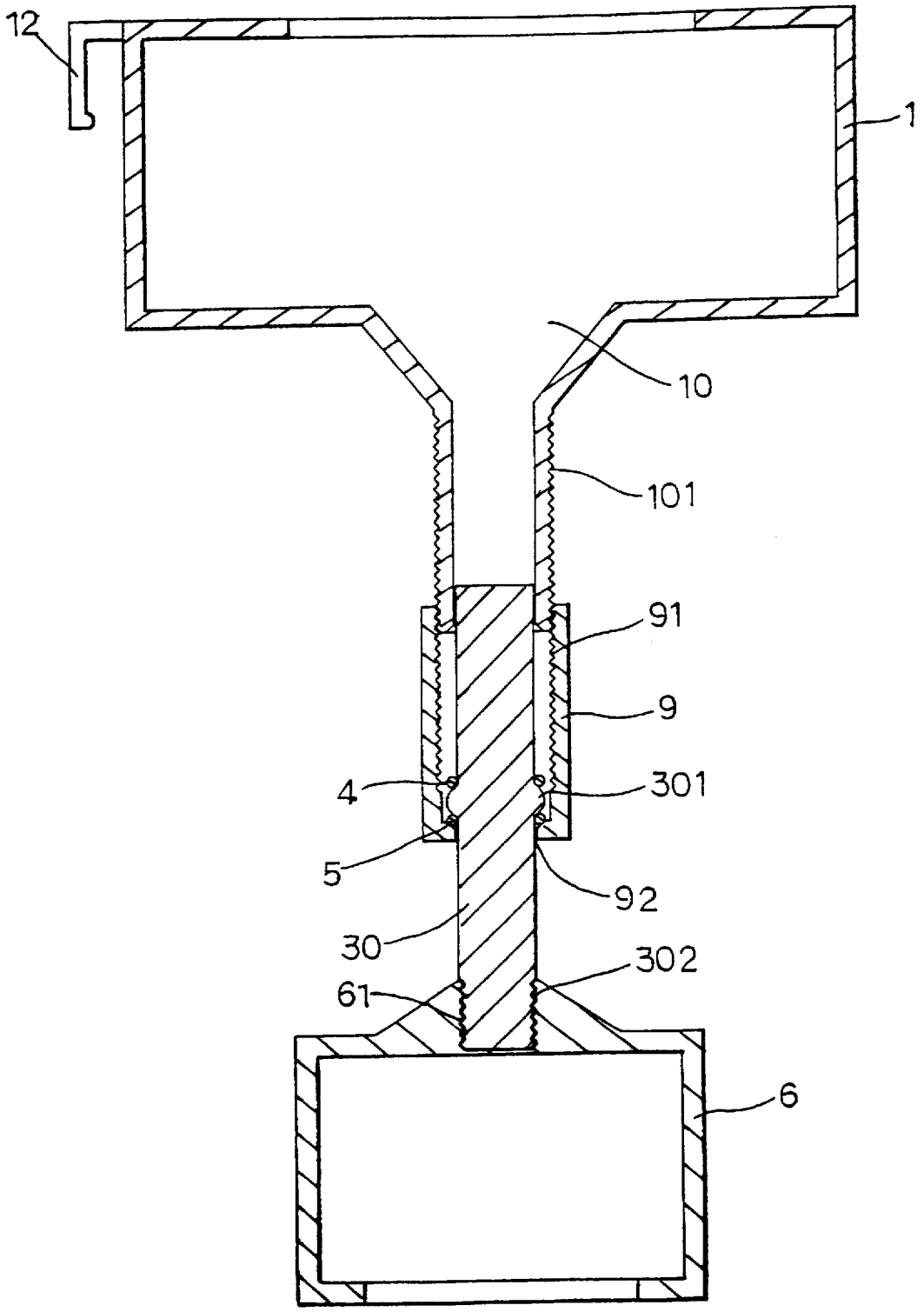
FIG. 3 is a sectional view of the present invention.

With reference to the drawings and in particular to FIGS. 1, 2 and 3 thereof, the detergent dispenser for toilets according to the present invention mainly comprises a container 1, an upper packing ring 4, a plug 30, a lower packing ring 5, a sleeve 9, and a buoy 6.

The container 1 is used to receive detergent and provided with a lug 12 adapted to engage with the upper edge of a tank 7. The container 1 is formed at the bottom with a convergent neck portion 10 which depends downwardly to form an externally threaded tubular portion 101. The tubular portion 101 has a chamfer cut round its opening at the lower end as a seating for an upper packing ring 4. The sleeve 9 provided with internal threads 91 is engaged with the tubular portion 101 of the container 1. The sleeve 9 is open at both ends and the opening 92 at the bottom is smaller than the opening (shown but not numbered) at the top. The opening 92 is chamferred at the upper portion so as to provide a seating for the lower packing ring 5. The plug 30 is provided with a plurality of longitudinal grooves and formed with an enlarged annular node 301 at the intermediate portion and external threads 302 at the lower end. The enlarged annular node 301 is larger than the opening 92 in diameter thereby preventing the plug 30 from dropping out of the sleeve 9. The upper packing ring 4 and the lower packing ring 5 are fitted on the upper side and the lower side of the annular node 31 of the plug 30, respectively. The buoy 6 provided with a threaded hole 61 at the top is engaged with the threads 302 at the lower end of the plug 30.

Figure 4:
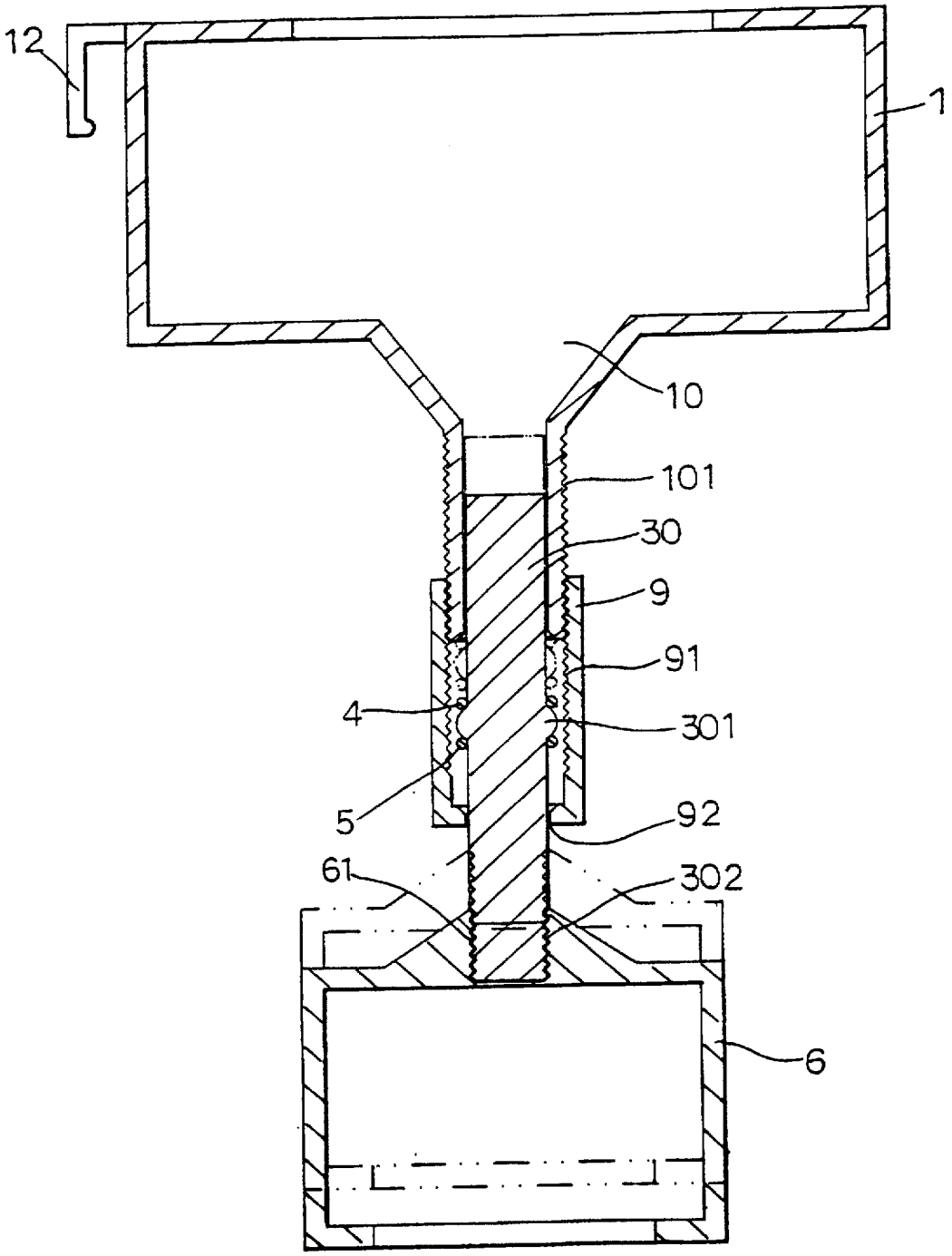
FIG. 4 illustrates the working principle of the present invention.
Figure 5:
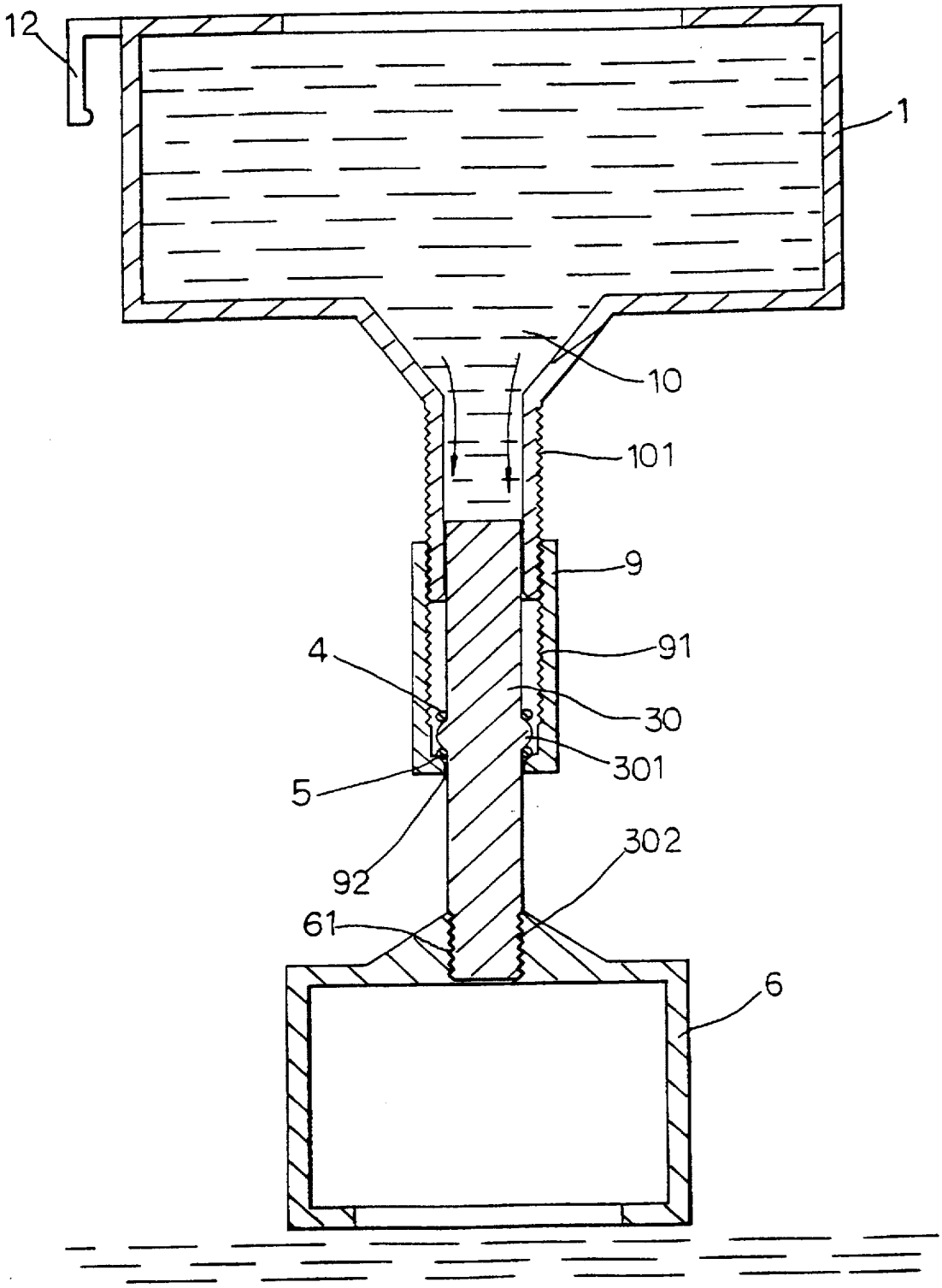
FIGS. 5, 6 and 7 illustrates how the detergent dispenser is automatically controlled by the water in the tank.

Referring to FIGS. 4 and 5, when the water level is below the buoy 6, the lower packing ring 5 together with enlarged annular node 301 of the plug 30 will engage with the chamferred opening 92 at the lower end of the sleeve 9 thereby preventing the detergent from flowing out of the sleeve 9.

Figure 6:
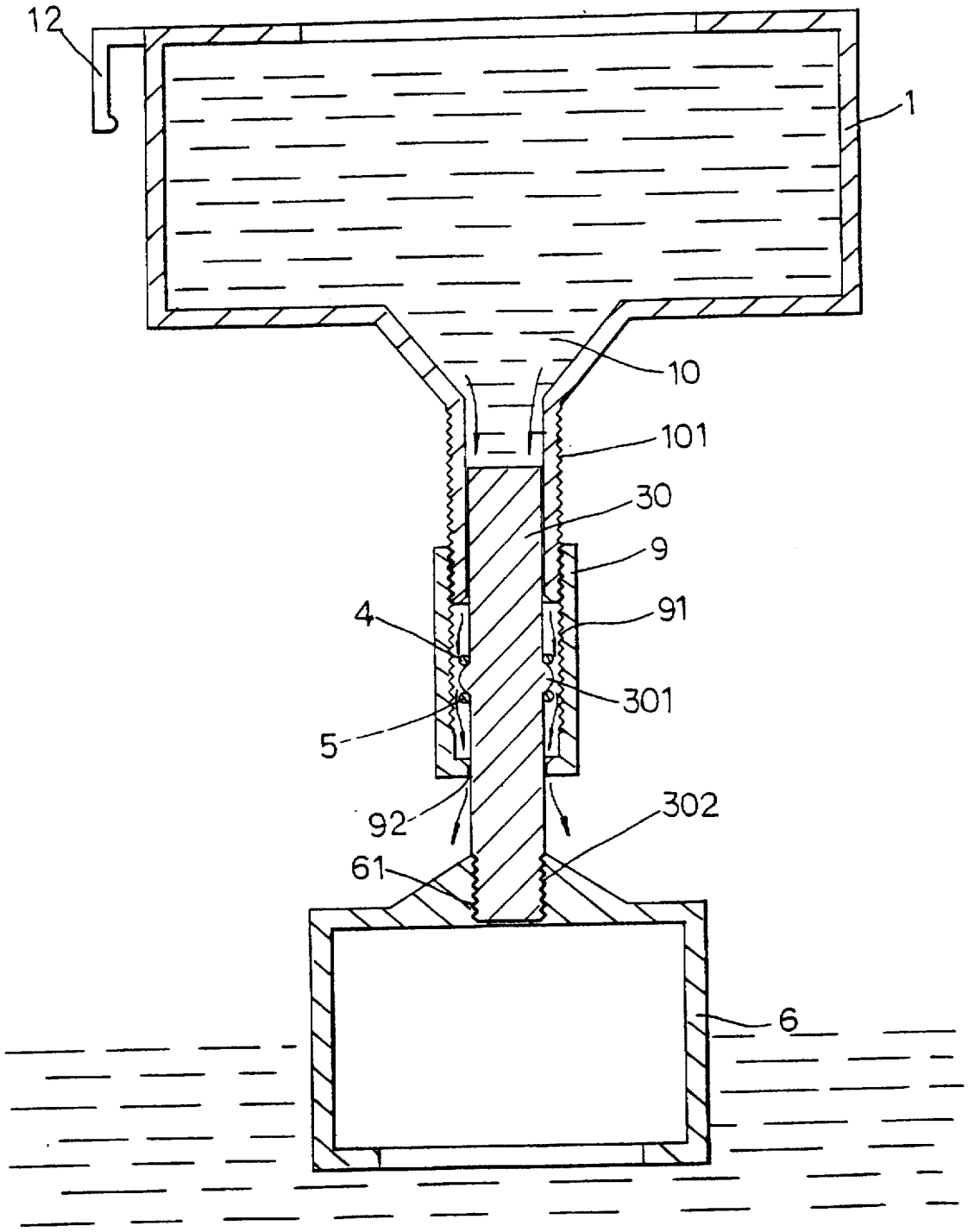

Turning to FIG. 6, when the water level rises, the buoy 6 will be lifted thus disengaging the enlarged annular node 301 of the plug 30 from the chamferred opening 92 at the lower end of the sleeve 9 thus enabling the detergent to flow out of the sleeve 9 through the longitudinal grooves of the plug 30.

Figure 7:
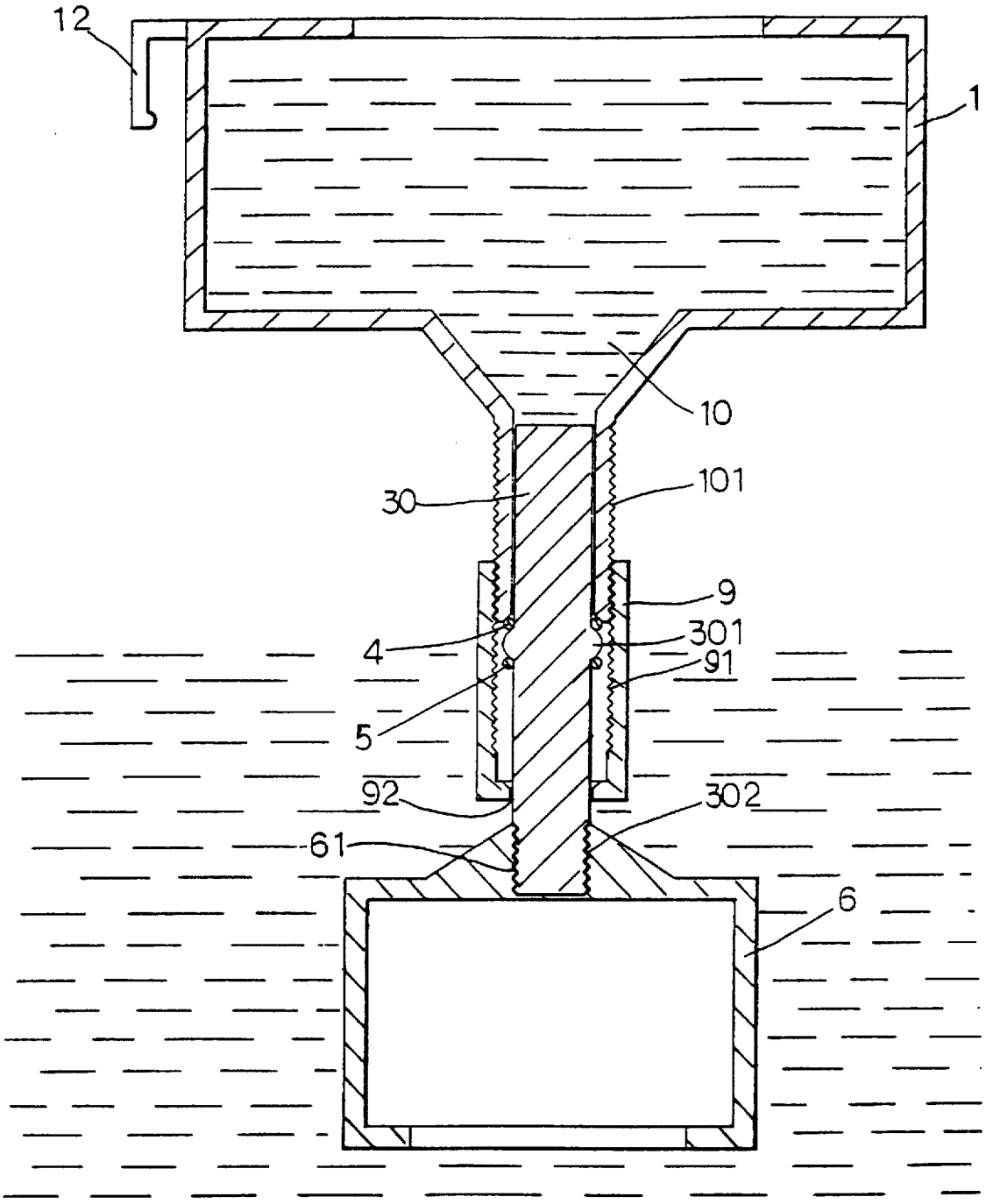
Figure 8:
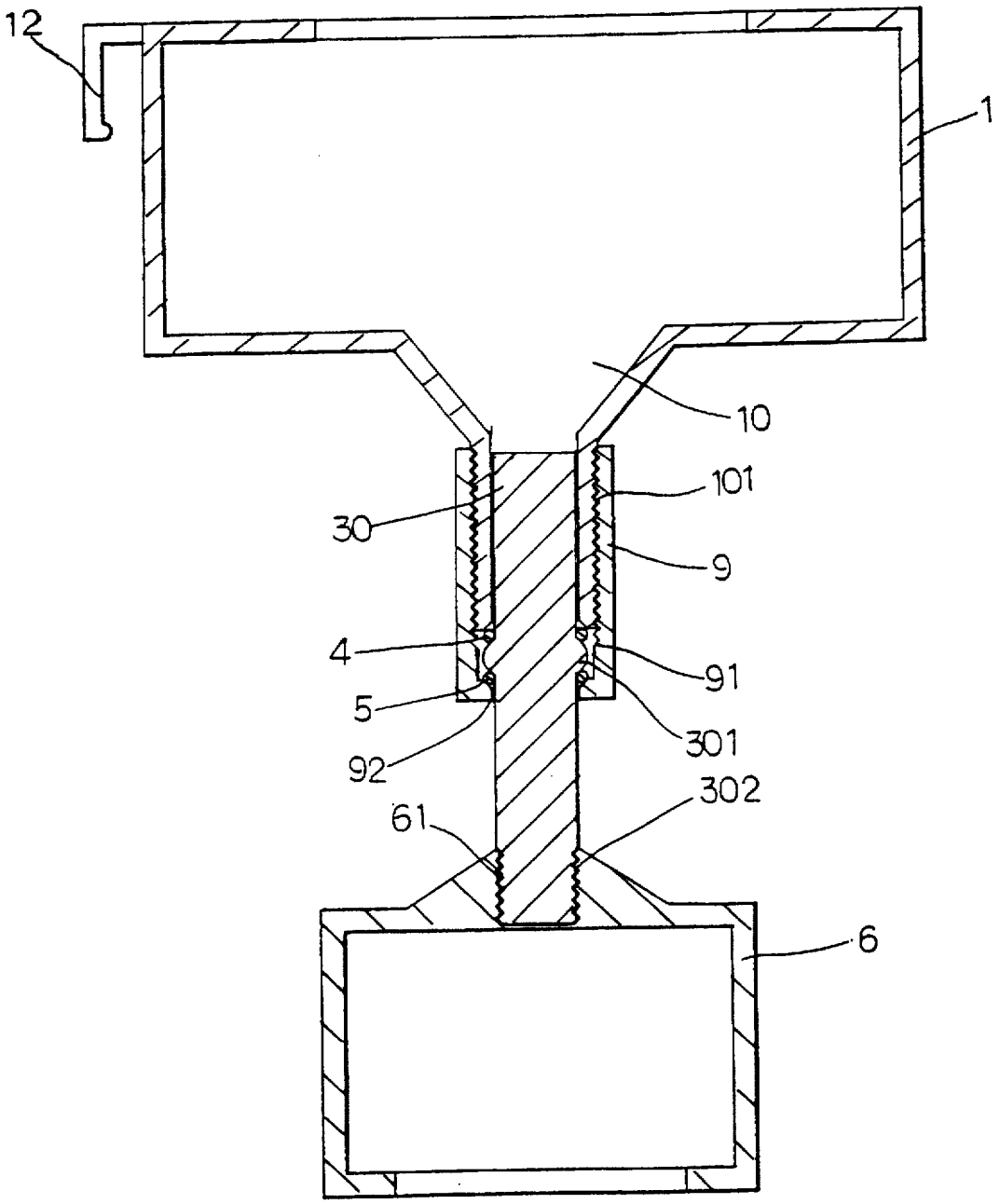
FIG. 8 is another sectional view of the present invention.

As shown in FIG. 7, in case the water rises to a predetermined level, the buoy 6 will lift the plug 30 to engage its enlarged annular node 301 with the chamferred opening at the lower end of the tubular portion 101 of the container 1 thereby preventing the detergent from flowing out of the tubular portion 101 of the container 1.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A detergent dispenser comprising:

a container having a bottom formed with a downwardly depending tubular portion provided with external threads thereon;

a plug having a plurality of longitudinal grooves and an enlarged annular node at an intermediate portion, said plug having an upper end inserted into the tubular portion of said container and an externally threaded lower end;

an upper packing ring mounted on a top of the enlarged annular node of said plug;

a lower packing ring mounted on a bottom of the enlarged annular node of said plug;

an internally threaded sleeve having an upper opening and a lower opening which is smaller than the upper opening and the enlarged annular node of said plug in diameter, said sleeve being put over said plug to engage with the tubular portion of said container with the enlarged annular node of said plug fitted within said sleeve; and a buoy threadedly engaged with the lower end of said plug.

2. The detergent dispenser as claimed in claim 1, wherein the tubular portion of said container has a chamferred opening at a lower end adapted to engage with said upper packing ring, and the lower opening of said sleeve is chamferred to adapt to engage with said lower packing ring.

* * * * *